US008875475B2

(12) United States Patent
Schwartau

(10) Patent No.: US 8,875,475 B2
(45) Date of Patent: Nov. 4, 2014

(54) MULTIPLE PANEL BEAMS AND METHODS

(71) Applicant: Millport Associates S.A., Panama (PA)

(72) Inventor: Ulrich Schwartau, Port d Andratx (ES)

(73) Assignee: Millport Associates S.A., Panama (PA)

( * ) Notice: Subject to any disclaimer, the term of this patent is extended or adjusted under 35 U.S.C. 154(b) by 0 days.

(21) Appl. No.: 13/804,471

(22) Filed: Mar. 14, 2013

(65) Prior Publication Data

US 2014/0260084 A1 Sep. 18, 2014

(51) Int. Cl.
*E04C 3/29* (2006.01)
*E04C 3/02* (2006.01)

(52) U.S. Cl.
CPC ..... *E04C 3/02* (2013.01)
USPC ..... 52/841; 52/745.17

(58) Field of Classification Search
CPC ..... E04C 1/40; E04C 2/22; E04C 3/28; E04C 3/29; E04C 3/36; E04C 3/185
USPC ..... 52/837, 838, 841, 847, 839, 745.17, 52/796.1
See application file for complete search history.

(56) References Cited

U.S. PATENT DOCUMENTS

| | | | | |
|---|---|---|---|---|
| 183,160 | A * | 10/1876 | Haughian | 428/598 |
| 1,377,891 | A * | 5/1921 | Knight | 52/841 |
| 1,496,022 | A | 6/1924 | Roberts et al. | |
| 1,664,867 | A | 4/1928 | Strand | |
| 1,671,084 | A | 5/1928 | Meyercord | |
| 2,120,200 | A | 6/1938 | Davis | |
| 2,231,345 | A | 12/1938 | Potchen | |
| 2,142,771 | A | 1/1939 | Alexander | |
| 2,181,164 | A | 11/1939 | Alexander | |
| 2,230,628 | A * | 2/1941 | Sahlberg | 52/841 |
| 2,255,151 | A | 9/1941 | Clements | |
| 3,079,649 | A * | 3/1963 | Willatts | 52/841 |
| 3,082,726 | A | 3/1963 | Dosker | |
| 3,112,043 | A | 11/1963 | Tucker | |
| 3,117,902 | A | 1/1964 | Holzheimer | |
| 3,170,269 | A | 2/1965 | Dunnington | |
| 3,256,666 | A | 6/1966 | Farmer | |
| 3,301,732 | A | 1/1967 | Kunz | |
| 3,308,013 | A | 3/1967 | Bryant | |
| 3,388,514 | A | 6/1968 | Archinal et al. | |

(Continued)

FOREIGN PATENT DOCUMENTS

| | | | |
|---|---|---|---|
| DE | 1609457 | A1 | 7/1970 |
| DE | 29 14 576 | A1 | 10/1979 |

(Continued)

OTHER PUBLICATIONS

International Search Report corresponding to PCT/EP2007/002591, mailed Jun. 22, 2007.

(Continued)

*Primary Examiner* — Christine T Cajilig
(74) *Attorney, Agent, or Firm* — Renner, Otto, Boisselle & Sklar, LLP

(57) ABSTRACT

A support beam and method for making a support beam, the support beam having a plurality of panels arranged side by side. The panels each have a core of insulative material and outer layers laminated to the core. The panels are adhered to one another and to top and bottom beam supports using bonding material.

19 Claims, 5 Drawing Sheets

(56) References Cited

U.S. PATENT DOCUMENTS 3,425,889 A 2/1969 Willits, Jr.
3,436,881 A 4/1969 Schlecht
3,440,790 A 4/1969 Nerem
3,462,897 A 8/1969 Weinrott
3,562,973 A 2/1971 Gangemi
3,590,540 A 7/1971 Johnson et al.
3,646,720 A 3/1972 Watts
3,647,590 A 3/1972 Wolf
3,708,385 A * 1/1973 Immethun ..... 428/119
3,719,016 A 3/1973 Randolph
3,791,910 A 2/1974 Bowser
3,866,381 A 2/1975 Eschbach et al.
3,909,995 A 10/1975 Bainter et al.
3,911,554 A 10/1975 Ford
3,949,532 A 4/1976 Jonsson et al.
3,969,868 A 7/1976 Bainter et al.
4,021,982 A 5/1977 Kotcharian
4,024,684 A 5/1977 Holmgren
4,050,609 A 9/1977 Okamoto et al.
4,074,489 A 2/1978 Eckel
4,074,498 A * 2/1978 Keller et al. ..... 52/690
4,176,504 A 12/1979 Huggins
4,177,306 A * 12/1979 Schulz et al. ..... 428/107
4,199,909 A 4/1980 Kotcharian
4,294,055 A 10/1981 Andresen
4,315,390 A 2/1982 Schaafsma
4,336,090 A 6/1982 Hilton
4,373,304 A 2/1983 Howitt
4,402,170 A 9/1983 Seidner
4,410,380 A 10/1983 Ahrweiler et al.
4,435,928 A 3/1984 Huling, III
4,696,137 A * 9/1987 Schleich ..... 52/251
4,704,837 A 11/1987 Menchetti et al.
4,841,710 A 6/1989 Considine
4,852,310 A 8/1989 Henley et al.
4,917,747 A 4/1990 Chin et al.
4,936,069 A 6/1990 Hunter et al.
5,100,713 A * 3/1992 Homma et al. ..... 428/102
5,129,628 A 7/1992 Vesper
5,274,974 A 1/1994 Haag
5,277,002 A 1/1994 Haag
5,285,616 A * 2/1994 Tripp ..... 52/837
5,305,577 A 4/1994 Richards et al.
5,310,594 A 5/1994 Holland et al.
5,349,796 A 9/1994 Meyerson
5,509,242 A 4/1996 Rechsteiner et al.
5,535,556 A 7/1996 Hughes, Jr.
5,557,904 A 9/1996 Dahowski
5,625,996 A * 5/1997 Bechtel ..... 52/843
5,652,039 A 7/1997 Tremain et al.
5,653,080 A * 8/1997 Bergeron ..... 52/839
5,718,786 A 2/1998 Lindquist et al.
5,743,056 A 4/1998 Balla-Goddard et al.
5,771,549 A 6/1998 Saaf
5,824,382 A 10/1998 Ruby
5,826,396 A 10/1998 Michaels
5,834,082 A * 11/1998 Day ..... 428/56
5,910,352 A 6/1999 Tingley
5,966,894 A * 10/1999 Crump, Jr. ..... 52/841
5,974,760 A * 11/1999 Tingley ..... 52/837
6,000,437 A 12/1999 Ponder et al.
6,050,208 A 4/2000 Kennedy
6,065,259 A 5/2000 Clear
6,085,469 A 7/2000 Wolfe
6,125,602 A 10/2000 Freiborg et al.
6,158,183 A 12/2000 Snell
6,176,637 B1 1/2001 Hatlan et al.
6,178,708 B1 1/2001 Porter
6,253,530 B1 7/2001 Price et al.
6,256,960 B1 7/2001 Babcock et al.
6,279,287 B1 8/2001 Meadows
6,295,786 B1 10/2001 Lee
6,298,619 B1 10/2001 Davie
6,305,142 B1 10/2001 Brisson et al.
6,412,247 B1 * 7/2002 Menchetti et al. ..... 52/847
6,446,412 B2 * 9/2002 Mathis ..... 52/847
6,511,257 B1 1/2003 Seaux et al.
6,565,942 B2 5/2003 Anderson et al.
6,584,740 B2 7/2003 Record
6,591,557 B1 7/2003 Thomsen et al.
6,604,328 B1 8/2003 Paddock
6,619,007 B1 9/2003 Riesmeier
6,627,018 B1 9/2003 O'Neill et al.
6,672,014 B1 1/2004 Jones
6,706,406 B1 3/2004 Kennedy
6,737,155 B1 5/2004 Ou
6,758,017 B2 7/2004 Young
6,941,720 B2 9/2005 Deford et al.
6,948,287 B2 9/2005 Korn
7,021,014 B1 4/2006 Wolfe
7,056,567 B2 6/2006 O'Neill et al.
7,062,885 B1 6/2006 Dickenson, Jr.
7,127,865 B2 10/2006 Douglas
7,225,596 B2 6/2007 Wrass
7,238,409 B1 * 7/2007 Peterson et al. ..... 428/156
7,371,304 B2 * 5/2008 Christman et al. ..... 156/293
7,393,577 B2 7/2008 Day et al.
7,448,172 B1 11/2008 Knodel
7,509,776 B2 3/2009 Reisman
7,581,366 B2 9/2009 Smith et al.
7,658,040 B2 2/2010 Bennett et al.
7,779,600 B1 8/2010 Saebi
7,836,641 B2 11/2010 Back et al.
7,997,037 B2 8/2011 Crandell et al.
7,997,044 B2 8/2011 Green et al.
8,016,230 B2 9/2011 Fogarty et al.
8,061,105 B2 11/2011 Haga
8,065,841 B2 11/2011 Antonic
8,142,879 B2 3/2012 Whitaker et al.
8,291,655 B2 10/2012 McGlothlin
8,470,425 B2 6/2013 Day et al.
8,474,197 B2 7/2013 Bennett et al.
8,511,043 B2 8/2013 Fyfe
2002/0038687 A1 4/2002 Anderson et al.
2002/0069600 A1 6/2002 Bryant
2002/0108342 A1 8/2002 Henits
2002/0139059 A1 10/2002 Zimmerman
2002/0144482 A1 10/2002 Henson et al.
2002/0176749 A1 11/2002 Provost
2002/0182955 A1 12/2002 Weglewski et al.
2003/0003258 A1 1/2003 Durso et al.
2003/0087572 A1 5/2003 Balthes et al.
2003/0089061 A1 5/2003 Deford et al.
2003/0145550 A1 8/2003 Bennett et al.
2003/0182886 A1 10/2003 Parrish
2004/0040234 A1 3/2004 Davison et al.
2004/0103601 A1 6/2004 Bergqvist
2004/0144040 A1 7/2004 Fulford et al.
2004/0211144 A1 10/2004 Stanchfield
2005/0064128 A1 3/2005 Lane et al.
2005/0126699 A1 6/2005 Yen et al.
2005/0138891 A1 6/2005 Wool et al.
2005/0167027 A1 8/2005 Lane
2005/0229504 A1 10/2005 Bennett et al.
2005/0229524 A1 10/2005 Bennett et al.
2005/0229531 A1 10/2005 Green et al.
2005/0257469 A1 11/2005 Bennett et al.
2006/0096205 A1 5/2006 Griffin et al.
2006/0144512 A1 7/2006 Carroll et al.
2006/0185305 A1 8/2006 Schaffer
2006/0225836 A1 10/2006 Lefevre et al.
2007/0022707 A1 * 2/2007 Gregg et al. ..... 52/735.1
2007/0025588 A1 2/2007 Bachmann et al.
2007/0125042 A1 6/2007 Hughes et al.
2008/0041013 A1 2/2008 Vetesnik et al.
2008/0124576 A1 5/2008 Elliott
2008/0236058 A1 10/2008 Antonie
2009/0004423 A1 1/2009 Dietz
2009/0255204 A1 * 10/2009 Schwartau ..... 52/582.1
2009/0255213 A1 * 10/2009 Schwartau ..... 52/794.1
2009/0282777 A1 11/2009 Schwartau
2009/0293396 A1 12/2009 Porter
2009/0307995 A1 12/2009 Schwartau
2009/0313926 A1 12/2009 Schwartau

(56) References Cited

U.S. PATENT DOCUMENTS

| | | | | |
|---|---|---|---|---|
| 2009/0320387 | A1 | 12/2009 | Schwartau | |
| 2010/0005732 | A1* | 1/2010 | Schwartau | 52/90.1 |
| 2010/0050542 | A1 | 3/2010 | Schwartau | |
| 2010/0050549 | A1* | 3/2010 | Schwartau | 52/284 |
| 2010/0050553 | A1 | 3/2010 | Schofield | |
| 2010/0209650 | A1 | 8/2010 | Schlueter | |

FOREIGN PATENT DOCUMENTS

| | | | |
|---|---|---|---|
| DE | 39 01 237 | A1 | 7/1990 |
| DE | 197 15 529 | C1 | 8/1998 |
| DE | 103 02 869 | B3 | 6/2004 |
| DE | 10 2005 054 608 | B3 | 3/2007 |
| DE | 20 2006 004 153 | U1 | 8/2007 |
| DE | 10 2006 018 110 | A1 | 9/2007 |
| DE | 20 2006 004 646 | U1 | 9/2007 |
| DE | 20 2006 004 985 | U1 | 9/2007 |
| EP | 0 105 411 | A | 4/1984 |
| EP | 0 249 592 | A2 | 12/1987 |
| EP | 0 438 766 | A | 7/1991 |
| EP | 0 478 033 | A | 4/1992 |
| EP | 0 843 054 | A2 | 5/1998 |
| EP | 1 393 892 | A | 3/2004 |
| FR | 2 154 655 | A | 5/1973 |
| FR | 2 831 229 | A1 | 4/2003 |
| GB | 559 527 | A | 2/1944 |
| GB | 1 375 877 | A | 11/1974 |
| GB | 2 225 282 | A | 5/1990 |
| GB | 2 399 539 | A | 9/2004 |
| JP | 2007-047622 | A | 2/2007 |
| SE | 461076 | B | 1/1990 |
| WO | 84/04727 | A | 12/1984 |
| WO | 85/02895 | A1 | 7/1985 |
| WO | 01/19603 | A1 | 3/2001 |
| WO | 01/59311 | A1 | 8/2001 |
| WO | 02/04876 | A1 | 5/2002 |
| WO | 02/40876 | A1 | 5/2002 |
| WO | 2007/104577 | A1 | 9/2007 |
| WO | 2007/107376 | A1 | 9/2007 |
| WO | 2007/110223 | A1 | 10/2007 |
| WO | 2007/121899 | A1 | 11/2007 |
| WO | 2009/125289 | A2 | 10/2009 |
| WO | 2009/125291 | A2 | 9/2010 |

OTHER PUBLICATIONS

International Search Report corresponding to PCT/EP2007/002684, mailed Aug. 7, 2007.
International Search Report corresponding to PCT/EP2007/003379, mailed Jul. 24, 2007.
International Search Report corresponding to PCT/EP2007/002350, mailed Jul. 13, 2007.
International Search Report and Written Opinion corresponding to PCT/IB2009/005223, mailed Feb. 9, 2010.
International Preliminary Report on Patentability corresponding to PCT/IB2009/005223, mailed Feb. 9, 2010.
International Search Report and Written Opinion corresponding to PCT/IB2009/005230, mailed Jul. 27, 2010.
International Preliminary Report on Patentability corresponding to PCT/IB2009/005230, mailed Jul. 27, 2010.
Ulrich Schwartau, "Multiple Panel Beams and Methods", U.S. Appl. No. 13/804,471, filed Mar. 14, 2013.
Ulrich Schwartau, "Multiple Panel Column and Methods", U.S. Appl. No. 13/804,777, filed Mar. 14, 2013.
Ulrich Schwartau, "Composite Sandwich Panels and Method of Forming Round Corners in Composite Sandwich Panels", U.S. Appl. No. 13/804,834, filed Mar. 14, 2013.
Ulrich Schwartau, "Columnar Structural Component and Method of Forming", U.S. Appl. No. 13/804,904, filed Mar. 14, 2013.
Ulrich Schwartau, "Columnar Structural Component and Method of Forming", U.S. Appl. No. 13/804,628, filed Mar. 14, 2013.
Ulrich Schwartau, "Ceiling Support Construction and Methods", U.S. Appl. No. 13/804,964, filed Mar. 14, 2013.
Ulrich Schwartau, "Nozzle System and Method for Manufacturing Composite Sandwich Panels", U.S. Appl. No. 13/826,025, filed Mar. 14, 2013.
Ulrich Schwartau, "System and Method for Using an Acetone Solvent to Clean Manufacturing Equipment Used to Manufacture Composite Sandwich Panels", U.S. Appl. No. 13/826,094, filed Mar. 14, 2013.
Ulrich Schwartau, "Apparatus and Method for Producing a Multi-Axis Laminate", U.S. Appl. No. 13/826,169, filed Mar. 14, 2013.

* cited by examiner

MULTIPLE PANEL BEAMS AND METHODS

FIELD OF THE INVENTION

The present invention relates generally to constructing buildings, and more particularly, to a support beam formed from a plurality of adjacent panels having insulative cores and outer layers and methods of making support beams.

BACKGROUND OF THE INVENTION

There is an increasing demand for lower-cost buildings such as houses, warehouses and offices. The demand for lower cost buildings is particularly strong in developing countries where economic resources may be limited and natural resources and raw materials may be scarce. For example, in areas of the Middle East or Africa, conventional building materials such as cement, brick, wood or steel may not be readily available or, if available, may be very expensive. In other areas of the world, poverty may make it too costly for people to build houses or other buildings with conventional materials.

The demand for lower-cost housing also is high in areas afflicted by war or natural disasters, such as hurricanes, tornados, floods, and the like. These devastating events often lead to widespread destruction of large numbers of buildings and houses, especially when they occur in densely populated regions. The rebuilding of areas affected by these events can cause substantial strain on the supply chain for raw materials, making them difficult or even impossible to obtain. Furthermore, natural disasters often recur and affect the same areas. If a destroyed building is rebuilt using the same conventional materials, it stands to reason that the building may be destroyed or damaged again during a similar event.

It is generally desirable to increase speed of construction and to minimize construction costs. Prefabricated or preassembled components can streamline production and reduce both the time and the cost of building construction. Prefabricated buildings, however, are made from conventional materials that may be scarce or expensive to obtain. Thus, there exists a need for alternative materials and techniques for constructing buildings that use advanced material technologies to increase the speed of construction and also reduce or lower the ownership costs.

BRIEF SUMMARY OF THE INVENTION

According to one aspect of the invention, a support beam includes a plurality of panels arranged side by side, a top support and a bottom support generally parallel to the top support and separated from the top support by the plurality of panels. Each of the panels has a core having a center portion, a top, a bottom, a first side and a second side, wherein at least one of the top of the core or the bottom of the core is angled from the center portion to at least one of the first side and the second side such that the length of the center portion is greater than the length of at least one of the first side or the second side. Each of the panels also has an outer layer in contact with the one of the first side or the second side having a length less than the length of the center portion of the core, the outer layer being positioned to extend beyond the length of the side with which the outer layer is in contact and terminate in substantially the same horizontal plane as the end of the center portion of the core.

In addition, the top of the core and the bottom of the core may be each angled from the center portion to at least one of the first side and the second side.

Also, at least one of the top of the core or the bottom of the core may be angled from the center portion to the first side and to the second side such that the length of the center portion is greater than the length of the first side and greater than the length of the second side.

Further, at least one of the panels may include a first outer layer in contact with the first side and a second outer layer in contact with the second side.

The support beam may also include bonding material between the panels. Moreover, the top support, outer layer and core may form a cavity, which may be triangular, and the cavity may be at least partially filled with bonding material. The cavity may, for example, have a length that is at least seven times the thickness of the other layer.

Further, at least one of the top support or the bottom support may extend horizontally beyond the plurality of panels and bonding material may join a major surface of the first side of the first of the plurality of panels to a major surface of at least one of the top support or the bottom support. Bonding material may join a major surface of the second side of the last of the plurality of panels to a major surface of at least one of the top support or the bottom support.

The outer layer and at least one of the top support or the bottom support may be formed from the same materials. In addition, at least one of the top support or the bottom support may be about 3 to 10 times as thick as the outer layer.

The core of the panels may be made of insulating materials and the outer layer of the panels may be made of composite materials.

According to another aspect of the invention a method for forming a support beam from a plurality of panels includes arranging a plurality of panels side by side, each panel having a top, a bottom, a first side and a second side, wherein the second side of a first panel is adjacent to the first side of a second panel; joining the plurality of panels with bonding material at each of the first side and second side of the plurality of panels, except for the first side of the first of the plurality of panels and the second side of the last of the plurality of panels; placing a top support adjacent to the top of the panels; joining a major surface of the first side of the first of the plurality of panels to a major surface of the top support using bonding material; joining a major surface of the second side of the last of the plurality of panels to the major surface of the top support using bonding material; placing a bottom support adjacent to the bottom of the panels; joining the major surface of the first side of the first of the plurality of panels to a major surface of the bottom support using bonding material; and joining the major surface of the second side of the last of the plurality of panels to the major surface of the bottom support using bonding material.

The step of joining a major surface of the first side of the first of the plurality of panels to a major surface of the top support may include forming the bonding material to a round corner.

In addition, each of the plurality of panels may include a core having a center portion, a top, a bottom, a first side and a second side, wherein at least one of the top of the core or the bottom of the core is angled from the center portion to at least one of the first side and the second side such that the length of the center portion is greater than the length of at least one of the first side or the second side; and an outer layer in contact with the one of the first side or the second side having a length less than the length of the center portion of the core, the outer layer being positioned to extend beyond the length of the side with which the outer layer is in contact and terminate in substantially the same horizontal plane as the end of the center portion of the core such that the outer layer and core form a cavity, and the method may include at least substantially filling the cavity in each of the plurality of panels prior to joining the top support and the plurality of panels.

The method may also include, for each of the plurality of panels, removing a portion of the core near the outer layer to form the cavity.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto.

It should be emphasized that the term "comprises/comprising" when used in this specification is taken to specify the presence of stated features, integers, steps or components but does not preclude the presence or addition of one or more other features, integers, steps, components or groups thereof.

Features that are described and/or illustrated with respect to one embodiment may be used in the same way or in a similar way in one or more other embodiments and/or in combination with, or instead of, the features of the other embodiments.

DETAILED DESCRIPTION OF THE INVENTION

Figure 1A:
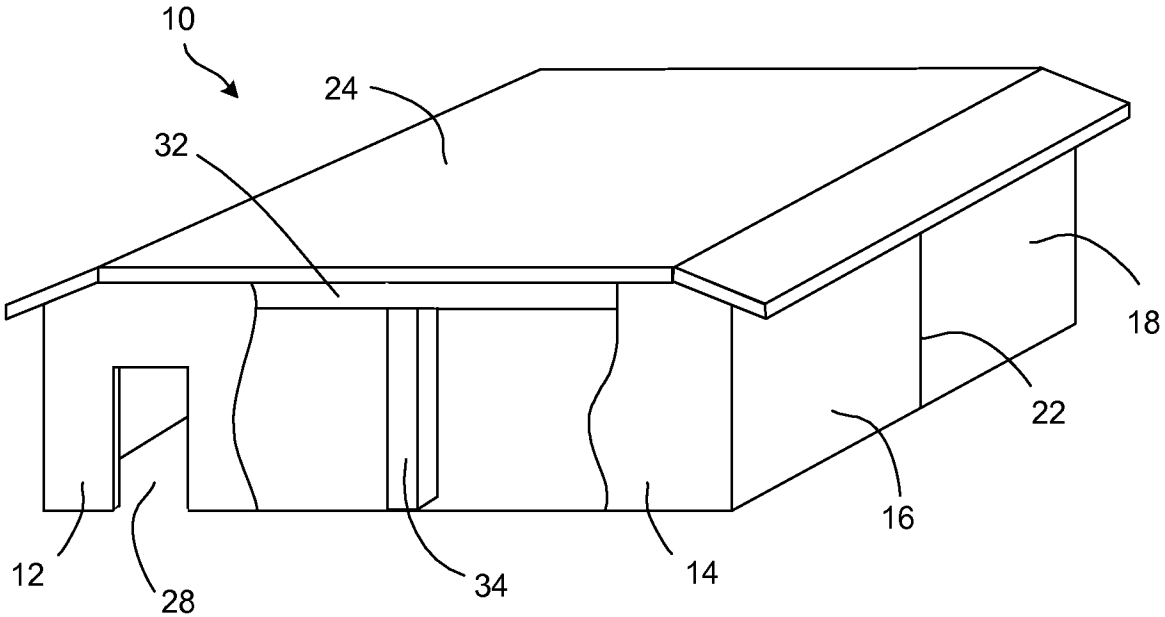
FIG. 1A is an environmental view of an exemplary monolithic structure built from composite materials.

In the detailed description that follows, like components have been given the same reference numerals regardless of whether they are shown in different embodiments of the invention. To illustrate the present invention in a clear and concise manner, the drawings may not necessarily be to scale and certain features may be shown in somewhat schematic form. Certain terminology is used herein to describe the different embodiments of the invention. Such terminology is used for convenience when referring to the figures. For example, "upward," "downward," "above," "below," "left," or "right" merely describe directions in the configurations shown in the figures. Similarly, the terms "interior" and exterior" or "inner" and "outer" may be used for convenience to describe the orientation of the components in the figures. The components can be oriented in any direction and the terminology should therefore be interpreted to include such variations. The dimensions provided herein are exemplary and are not intended to be limiting in scope. Furthermore, while described primarily with respect to house construction, it will be appreciated that the concepts described herein are equally applicable to the construction of any type of structure or building, such as warehouses, commercial buildings, factories, apartments, etc.

The present invention provides an alternative to conventional construction materials and techniques. Buildings, such as houses, commercial buildings, warehouses, or other structures can be constructed by composite panels, which have an insulative core and one or more outer layers. The buildings can be constructed by connecting several panels together with a bonding material, and usually screws, rivets, nails, etc., are not needed for such connections. Generally, composite panels offer a greater strength to weight ratio over traditional materials that are used by the building industry. The composite panels are generally as strong as, or stronger than, traditional materials including wood-based and steel-based structural insulation panels, while being lighter in weight. The composite panels also can be used to produce light-weight buildings, such as floating houses or other light-weight structures. Because they weigh less than traditional building materials, composite panels are generally less expensive to transport and may be generally easier to handle during construction.

Composite panels are generally more elastic or flexible than conventional materials such as concrete, steel or brick and, therefore, monolithic buildings made from panels are more durable than buildings made from conventional materials. For example, composite panels also may be non-flammable, waterproof and very strong and durable, and in some cases able to resist hurricane-force winds (up to 300 Kph (kilometers per hour)). The composite panels also may be resistant to the detrimental effects of algae, fungicides, water, and osmosis. As a result, buildings constructed from composite panels are better able to withstanding earthquakes, floods, tornados, hurricanes, fires and other natural disasters than buildings constructed from conventional materials.

The structures described herein are built with composite materials, such as composite panels (also referred to as "sandwich panels" or "panels"). Panels, which may be formed from synthetic materials, provide a light-weight and potentially less expensive alternative to conventional raw materials, e.g., wood, concrete, metal, etc. Panels are usually connected or joined together with a high-strength bonding material, such as epoxy or glue, and conventional materials, such as nails and screws, are not usually needed. The result is a strong and durable monolithic (e.g., single unit) structure, as described further below.

Referring to FIG. 1A, an exemplary monolithic structure 10, such as a house, is built from panels. The house 10 includes of a front wall formed from two panels 12, 14 connected by a straight joint (not shown), a side wall formed from two panels 16, 18 connected by a straight joint 22, and a roof 24. As shown in FIG. 1A, the straight joint joins two panels in a substantially common plane, e.g. a 180-degree joint. Also illustrated is a doorway 28. Although not shown in FIG. 1A, it will be appreciated that the house 10 also includes another side wall and a rear wall, which also may be formed by adjacent panels connected by straight joints.

Exemplary panels and methods for forming a monolithic structure, such as the monolithic structure 10, are disclosed in U.S. application Ser. No. 12/101,620, filed Apr. 11, 2008, the entirety of which is incorporated by reference herein.

Like with any standard building material, columns, such as column 34, and beams, such as beam 32, may be useful to support roofs or additional levels of a building when the distance between support walls exceeds acceptable standards for the amount of support desired. In such instances a support beam, such as that illustrated in FIGS. 1B and 2, may be used.

Figure 1B:
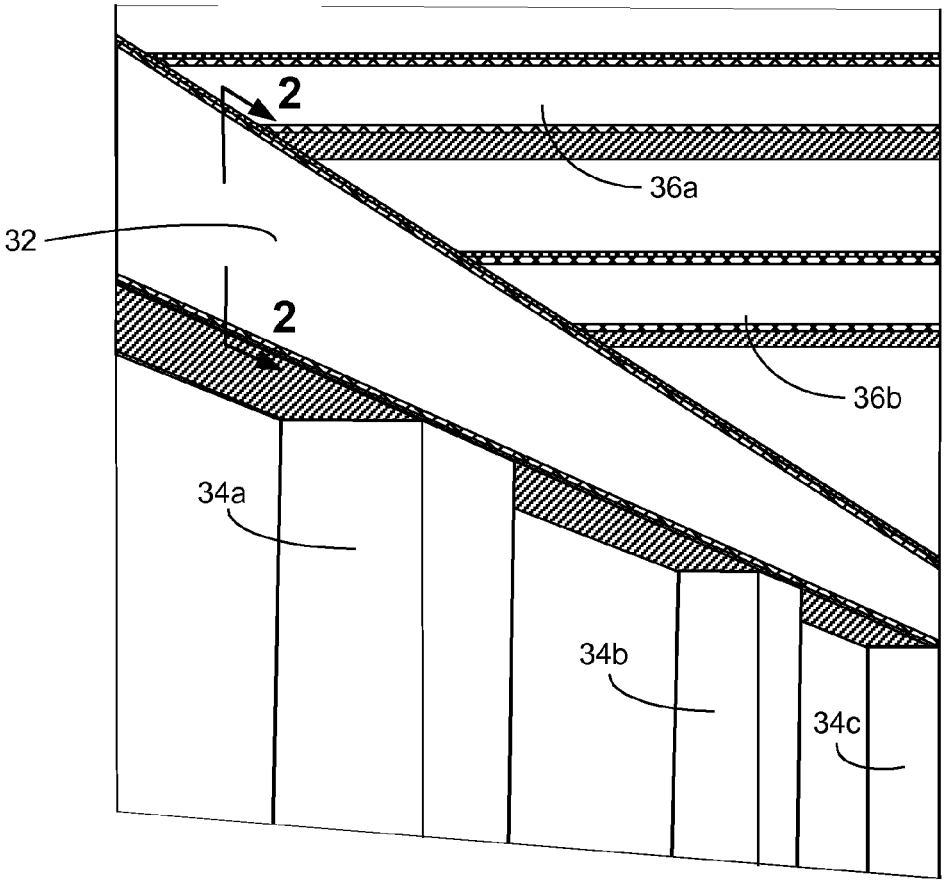
FIG. 1B is an environmental view of an exemplary support beam made from composite panels.

Turning next to FIG. 1B, an exemplary beam according to the present invention is illustrated in an exemplary environmental view. As shown, a beam 32 sits atop multiple columns 34*a-c* and supports multiple additional beams 36*a-b*, which may be identical to the beam 32. The beams 36*a-b* may in turn support a ceiling. Alternatively, the beam 32 may support a ceiling directly without the additional beams 34*a-b*. One of skill in the art will recognize the various uses for support beams in the construction of various types of structures, monolithic or otherwise.

Figure 2:
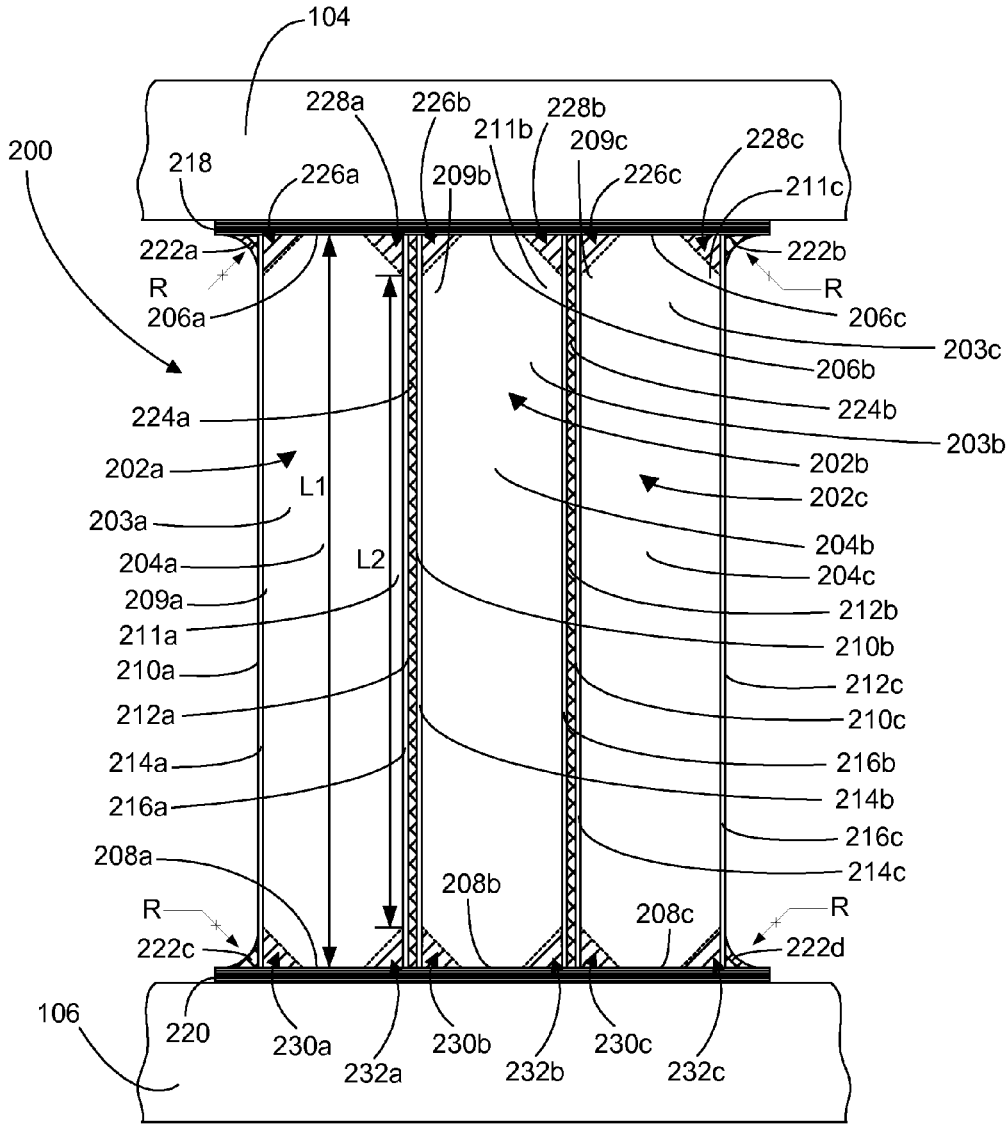
FIG. 2 is a front elevation view of a support beam made from composite panels; viewed generally from the angle illustrated in FIG. 1B.

Turning next to FIG. 2 a support beam 200 formed from multiple composite panels is illustrated. The support beam 200 may be identical to the support beams 32*a-c* of FIG. 1B and is formed from several, e.g. two to eight (or more), panels placed adjacent to one another and cut to a desired height to span the distance between levels 102 and 104 such that level 102 is supported by the support beam 200.

For example, the level 104 may be a ceiling or another support beam, such as the support beams 36*a-b* of FIG. 1B, which may be oriented at 90 degrees from the support beam 200. Similarly, level 102 may be a column, such as the columns 34*a-c* of FIG. 1B, or another support beam, which may be oriented at 90 degrees from the support beam 200.

As illustrated in FIG. 2, the support beam 200 includes multiple composite panels—three in the embodiment illustrated—202*a-c* arranged side by side, e.g., in stacked relation. In other words, the panels 202*a-c* are arranged such that opposing major surfaces of the panels, i.e., the surfaces of the sides 209*a-c* and 211*a-c* of the panels 202*a-c*, face one another, e.g., as shown. It will be understood by those of skill in the art that the number of panels may vary depending on the load to be supported, but that support beams having from two to eight panels would be used for most applications. Each of the panels 202*a-c* includes a core 204*a-c* having a top side 206*a-c*, a bottom side 208*a-c*, a first side 209*a-c* and a second side 211*a-c*. In addition, an outer layer may be attached to one or more of the first side 209*a-c* and the second side 211*a-c* of the core 204*a-c*. For example, the embodiment of FIG. 2 illustrates a first outer layer 214*a-c* on each of the first sides 209*a-c* of the core 204*a-c* and a second outer layer 216*a-c* on each of the second sides 211*a-c* of the cores 204*a-c*. Thus, in the embodiment illustrated, the panels 202*a-c* each have a first outer layer 214*a-c* on the first side 210*a-c* of the panel 202*a-c* and a second outer layer 216*a-c* on the second side 212*a-c* of the panel 202*a-c*.

The panels 202*a-c* are joined using bonding material 224*a-b* at each of the first side 210*b-c* and second side 212*a-b* of the plurality of panels, except for the first side 210*a* of the first of the plurality of panels 202*a* and the second side 212*c* of the last of the plurality of panels 202*c*. For example, the bonding material 224*a* may be placed on the outer layers 216*a*, 214*b* and bonding material 224*b* may be placed on the outer layers 216*b* and 214*c* when the support beam 200 is formed from three panels as in the embodiment of FIG. 2. The bonding material may or may not cover the entire surface of the outer layers 216*a* and 214*b*. In addition, the bonding material may or may not cover the entire surface of the outer layers 216*b* and 214*c*. For example, the bonding material may cover about 50 percent of the surface to be bonded. The bonding material may be any suitable bonding material such as epoxy, epoxy resin, glue, adhesive, adhering material or another bonding material (these terms may be used interchangeably and equivalently herein). The bonding material may include filling components, such as, fiberglass or a fiberglass and resin mixture, and may, for example, be microfiber and/or AEROSIL® material.

A top support 218 is placed adjacent to the top 206*a-c* of the panels 202*a-c* and a major surface of the top support 218 is joined to a major surface of the first side 210*a* of the first panel 202*a* using bonding material 222*a*, such as that described above and/or elsewhere herein. In the illustrated exemplary embodiment of FIG. 2, the top support 218 extends horizontally beyond the plurality of panels 202*a-c*. The top support 218 may be joined to a major surface of the second side 212*c* of the last panel 202*c* using bonding material 222*b*. In addition, a bottom support 220 is placed adjacent to the bottom of the panels 208*a-c*, and thus separated from the top support 218 by the plurality of panels 202*a-c*, and a major surface of the bottom support 220 may be joined to a major surface of the first side 210*a* of the first panel 202*a* using bonding material 222*c*. The bottom support 220 is joined to a major surface of the second side 212*c* of the last panel 202*c* using bonding material 222*d*.

The bonding material 222*a-d* may be shaped into a round corner to form a radius R. The length of the radius R may be selected based upon the thicknesses of the outer layers 214*a-c* and 216*a-c* according to a desired ratio. The desired ratio of the radius R to the thickness of the outer layers 214*a-c*, 216*a-c* may each be about seven to one (7:1), or more, e.g., 8:1 or an even larger ratio. For instance if the outer layers 214*a-c*, and 216*a-c* are approximately 2 mm (millimeters) thick, the radius R would be at least approximately 14 mm (millimeters), and may be thicker, if desired. In addition, the radius R may be adjusted based upon a desired strength or other factor. In another example, the outer layers 214*a-c* and 212*a-c* may each be approximately 3 mm (millimeters) thick, the radius R would be at least approximately 21 mm (millimeters) or more.

Turning next to the panels 202*a-c*, each of the panels 202*a-c* includes a core 203*a-c* having a center portion 204*a-c*, a top 206*a-c*, a bottom 208*a-c*, a first side 210*a-c* and a second side 212*a-c*. For simplicity, the description of the panels focuses on panel 202*a* but it is understood that panels 202*b* and 202*c* may include any or all of the elements of panel 202*a* discussed herein. As shown in the panel 202*a*, the top of the core 203*a* is angled from the center portion 204*a* to the first side 210*a*. The top of the core 203*a* may also be angled from the center portion 204*a* to the second side 212*a*. In other words, the length L1 of the center portion 204*a* is greater than, for example, the length L2 of the second side 212*a*. In addition, the bottom 208*a* of the core 203*a* may be angled from the center portion 204 to one or more of the first side 210*a* or the second side 212*a*.

In contact with at least one of the first side 210*a* of the core 203*a* or the second side 212*a* is an outer layer, such as the first outer layer 214*a* or the second outer layer 216*a*. Preferably, the outer layer 214*a* or 216*a* is laminated to the first side 210*a* of the core 203*a* or second side 212*a* of the core 203*a*. As shown in FIG. 2, the first outer layer 214*a* is laminated to the first side 210*a* of the core and the second outer layer 216*a* is laminated to the second side 212*a*. In addition, the first outer layer 214*a* is positioned to extend beyond the length of the first side 210*a* of the core and terminate in substantially the same horizontal plane as the top 206*a* of the center portion 204*a* of the core 203*a*, thereby forming a cavity 226*a*. Similarly, the second outer layer 216*a* is positioned to extend beyond the length of the second side 212*a* of the core 203*a* and terminate in substantially the same horizontal plane as the end 206*a* of the center portion 204*a* of the core 203*a*, thereby forming a cavity 228*a*.

The first outer layer 214*a* may also be positioned to extend beyond the length of the first side 210*a* of the core 203*a* and terminate in substantially the same horizontal plane as the bottom 208*a* of the center portion 204*a* of the core 203*a*, thereby forming a cavity 230*a*; and the second outer layer 216*a* may be positioned to extend beyond the length of the second side 212*a* of the core 203*a* and terminate in substantially the same horizontal plane as the end 208*a* of the center portion 204*a* of the core 203*a*, thereby forming a cavity 232*a*.

As shown, each of the cavities 226*a*, 228*a*, 230*a* and 232*a* may be generally triangular in shape. In the illustrated exemplary embodiment, at least one of the cavities 226*a*, 228*a*, 230*a* and 232*a* is at least partially filled with bonding material, for example, prior to joining the top support 218 or bottom support 220 to the panel 202*a*.

Turning next to the top support 218 and bottom support 220, each of the top support 218 and bottom support 220 may be formed from multiple layers of composite materials. For example, the top support 218 and/or the bottom support 220 may be formed from the same material as the outer layer, such as the first outer layer 214*a* or second outer layer 216*a*. In addition, the top support 218 and/or the bottom support 220 may be about 3 to 10 times as thick as the outer layer 214*a* or 216*a*. In addition, bonding material may be used to adhere the top support 218 to level 102 and/or to adhere the bottom support 220 to level 104.

Figure 3A:
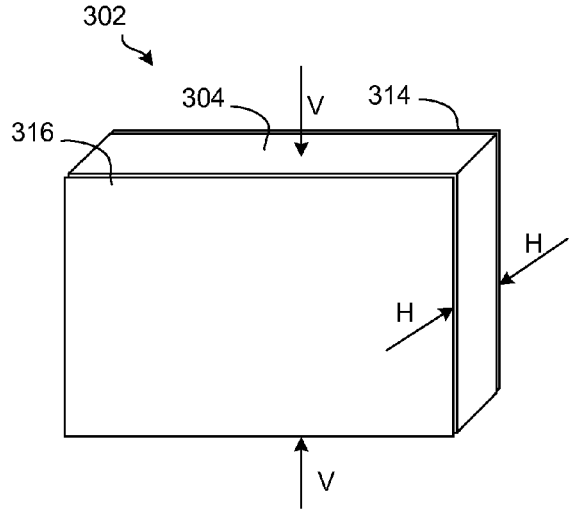
FIG. 3A is an isometric view of a panel.
Figure 3B:
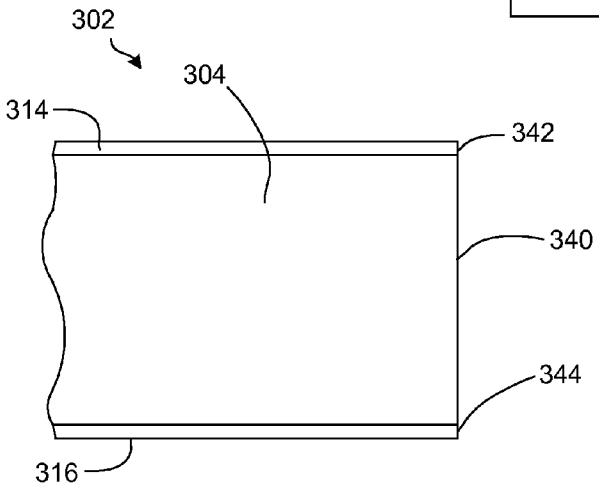
FIG. 3B is a fragmentary schematic top sectional view of an edge of a panel.
Figure 3C:
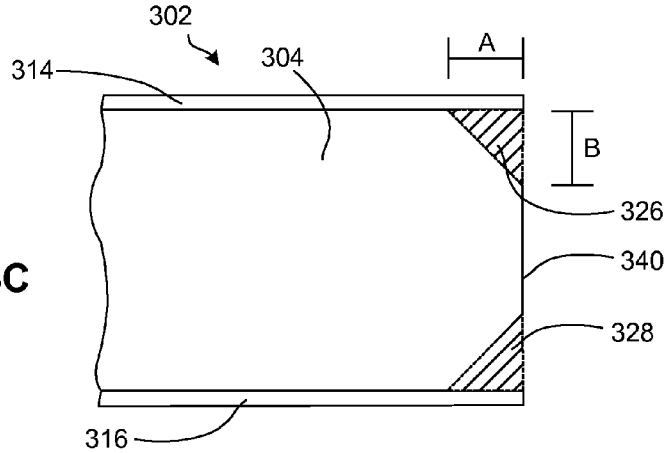
FIG. 3C is a fragmentary schematic top sectional view of an edge of a panel prepared for use in a support beam.

Turning next to FIGS. 3A-C, an exemplary panel 302, such as panels 202*a-c* of FIG. 2, is illustrated. The panel 302 includes two outer layers 314 and 316 separated by a core 304, e.g., corresponding to the outer layers 214*a* and 216*a* and the core 203*a*, which are described above. The core 304 may be formed from a light-weight, insulative material, for example, polyurethane, expanded polystyrene, polystyrene hard foam, STYROFOAM® material, phenol foam, a natural foam, for example, foams made from cellulose materials, such as a cellulosic corn-based foam, or a combination of several different materials. Other exemplary core materials include honeycomb that can be made of polypropylene, non-flammable impregnated paper or other composite materials. The core may be any desired thickness and may be, for example, 30 mm (millimeters)-100 mm (millimeters) thick, however, it will be appreciated that the core can be thinner than 30 mm (millimeters) or thicker than 100 mm (millimeters) as may be desired. In one embodiment, the core is about 60 mm (millimeters) thick.

The outer layers 314 and 316 of a panel, e.g., panel 302 of FIGS. 3A-C, are made from a composite material that includes a matrix material and a filler or reinforcement material. Exemplary matrix materials include a resin or mixture of resins, e.g., epoxy resin, polyester resin, vinyl ester resin, natural (or non oil-based) resin or phenolic resin, etc. Exemplary filler or reinforcement materials include fiberglass, glass fabric, carbon fiber, or aramid fiber, etc. Other filler or reinforcement materials include, for example, one or more natural fibers, such as, jute, coco, hemp, or elephant grass, balsa wood, or bamboo.

The outer layers 314 and 316 (also referred to as laminate) may be relatively thin with respect to the panel core 304. The outer layers 314 and 316 may be several millimeters thick and may, for example, be between approximately 1 mm (millimeter)-12 mm (millimeters) thick; however, it will be appreciated that the outer layers can be thinner than 1 mm (millimeter) or thicker than 12 mm (millimeters) as may be desired. In one embodiment, the outer layers are approximately 1-3 mm (millimeter) thick.

It will be appreciated that the outer layers 314 and 316 may be made thicker by layering several layers of reinforcement material on top of one another. The thickness of the reinforcement material also may be varied to obtain thicker outer layers 314 and 316 with a single layer of reinforcement material. Further, different reinforcement materials may be thicker than others and may be selected based upon the desired thickness of the outer layers.

The outer layers 314 and 316 may be adhered to the core 304 with the matrix materials, such as the resin mixture. Once cured, the outer layers 314 and 316 of the panel 302 are firmly adhered to both sides of the panel core 304, forming a rigid building element. It will be appreciated that the resin mixture also may include additional agents, such as, for example, flame retardants, mold suppressants, curing agents, hardeners, etc. Coatings may be applied to the outer layers 314 and 316, such as, for example, finish coats, paint, ultraviolet (UV) protectats, water protectats, etc. The outer layers 314 and 316 may function to protect the core 304 from damage and may also provide rigidity and support to the panel 302.

The panels 302 may be any shape. In one embodiment, the panels 302 are rectangular in shape and may be several meters, or more, in height and width. The panels 302 also may be other shapes and sizes. The combination of the core 304 and outer layers 314 and 316 create panels with high ultimate strength, which is the maximum stress the panels can withstand, and high tensile strength, which is the maximum amount of tensile stress that the panels can withstand before failure. The compressive strength of the panels is such that the panels may be used as both load bearing and non-load bearing walls. In one embodiment, the panels have a load capacity of at least 50 tons per square meter in the vertical direction (indicated by arrows V in FIG. 3A) and 2 tons per square meter in the horizontal direction (indicated by arrows H in FIG. 3A). The panels may have other strength characteristics as will be appreciated in the art.

Internal stiffeners may be integrated into the panel core 304 to increase the overall stiffness of the panel 302. In one embodiment, the stiffeners are made from materials having the same thermal expansion properties as the materials used to construct the panel, such that the stiffeners expand and contract with the rest of the panel when the panel is heated or cooled.

The stiffeners may be made from the same material used to construct the outer layers of the panel. The stiffeners may be made from composite materials and may be placed perpendicular to the top and bottom of the panels and spaced, for example, at distances of 15 cm (centimeters), 25 cm, 50 cm, or 100 cm. Alternatively, the stiffeners may be placed at different angles, such as a 45-degree angle with respect to the top and bottom of the panel, or at another angle, as may be desired.

FIG. 3B depicts a top view of a panel 302, e.g., like the respective panels 202*a-c*, which are described above. As shown in FIG. 3B, the edge 340 of the panel is flush or even with the edges 342 and 344 of the outer layers 314 and 316, respectively. It will be appreciated that while shown in the illustrated embodiment as a generally straight edge, the edge may be shaped, for example into an "S" shape, or another shape.

Referring now to FIG. 3C, portions of the core 304 are removed from the panel 302 to create combined cavities 326 and 328, e.g., like respective pairs of cavities 226*a*, 228*a* and 230*a*, 232*a*, which are described above. Bonding material may be placed or injected into the combined cavities 326 and 328 to facilitate adherence to the top support 218 or bottom support 220 illustrated in FIG. 1. The cavities 326 and 328 extend along an inner edge of the outer layers 314 and 316, designated generally as "A," and also perpendicularly from the outer layer and towards the center of the core 304, designated generally as "B." The dimensions A, B of the cavities 326 and 328 are several millimeters in length, and may, for example be approximately 15-20 mm (millimeters) long.

The dimensions A, B also may be selected based upon the thicknesses of the outer layers 314 and 316 according to a desired ratio. The desired ratio of the dimensions A, B to the thickness of the outer layers 314 and 316 may be approximately seven to one (7:1), or more, e.g., 8:1 or an even larger ratio. For instance if the outer layers 314 and 316 are about 2 mm (millimeters) thick, the dimensions A, B would be at least about 14 mm (millimeters), and may be thicker, if desired, or adjusted based upon a desired safety factor.

As shown, the cavities 326 and 328 are symmetrical with one another and each form the general shape of an isosceles right triangle, having a 45-degree hypotenuse and legs A, B. It will be appreciated that the shapes of the cavities 326 and 328 are exemplary of only one embodiment and numerous other configurations may be possible. For example, the cavities need not be symmetrical. Also, more core material may be removed for larger (e.g., thicker) outer layers 314 and 316 or less core material may be removed for smaller (e.g., thinner) outer layers 314 and 316. Alternatively, the cavities 326 and 328 need not be triangular in shape and may, for example, be similar to another shape, such as a curved shape, a circular (or partial circular) shape, a rectangular shape or a square shape, etc. It will be appreciated that the core 304 and outer layers 314 and 316 may be formed in the configuration of FIG. 3C prior to or after adhering the outer layers 314, 316 to the core 304, or the panel may be molded to the desired shape.

Figure 4:
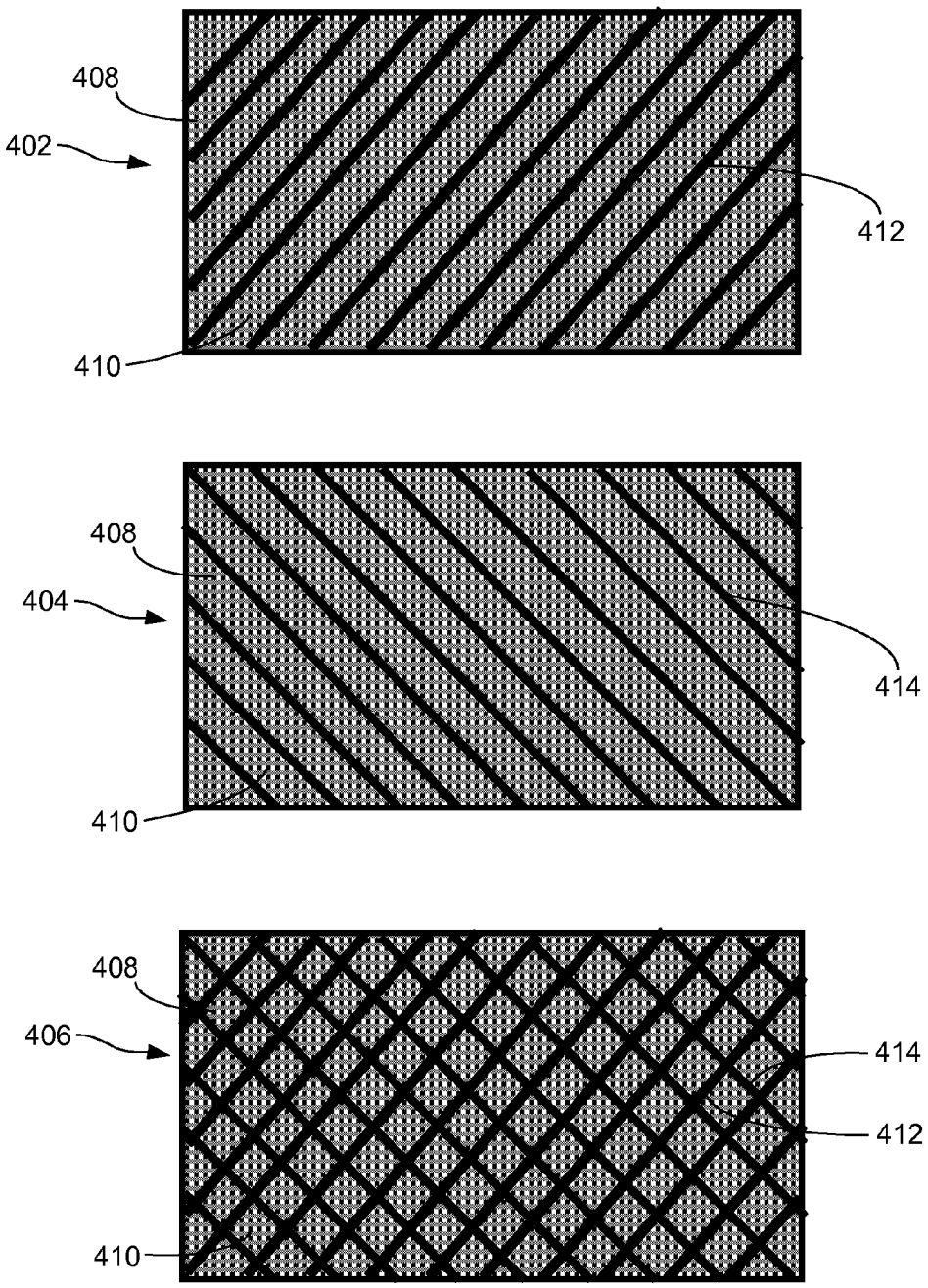
FIG. 4 illustrates multiple layers of the top support or the bottom support of the support beam of FIG. 2.

Turning next to FIG. 4, multiple layers of a support, such as the top support 218 or bottom support 220 are illustrated. Each of the layers 402 and 404 is made of composite material, such as the composite material used to make the laminate outer layers 314 and 316. Each of the layers 402 and 404 may have fibers oriented in 3-axes. The layer 402 has fibers 408 oriented at 0 degrees, fibers 410 oriented at 90 degrees and fibers 412 oriented at +45 degrees. The layer 404 has fibers 408 oriented at 0 degrees, fibers 410 oriented at 90 degrees and fibers 414 oriented at −45 degrees. The layer 402 and layer 404 may be substantially identical in fiber configuration, except that layer 404 is upside down. At least a portion of a 4-axis support 406, such as the supports 218 and 220, may be formed by adhering layer 402 and layer 404. Once adhered, the layers 402 and 404 form a single support 406 having fibers 408 oriented at 0 degrees, fibers 410 oriented at 90 degrees, fibers 412 oriented at +45 degrees and fibers 414 oriented at −45 degrees. Thus, the support beam 200 of FIG. 2 may be made by adhering multiple 3-axis layers to form the supports 218 and 220.

Although the invention has been shown and described with respect to a certain preferred embodiment or embodiments, it is obvious that equivalent alterations and modifications will occur to others skilled in the art upon the reading and understanding of this specification and the annexed drawings.

While the present invention has been described in association with exemplary embodiments, the described embodiments are to be considered in all respects as illustrative and not restrictive. Such other features, aspects, variations, modifications, and substitution of equivalents may be made without departing from the spirit and scope of this invention which is intended to be limited only by the scope of the following claims. Also, it will be appreciated that features and parts illustrated in one embodiment may be used, or may be applicable, in the same or in a similar way in other embodiments.

What is claimed is:

1. A support beam comprising:

a plurality of panels arranged side by side sandwich relation, each panel comprising:

a core having a center portion, a top, a bottom, a first side and a second side, and a first outer layer in contact with the first side, a second outer layer in contact with the second side, a top support; and a bottom support generally parallel to the top support and separated from the top support by the plurality of panels;

a bonding material between a major surface of at least one of the top support and/or the bottom support and at least one of the plurality of panels, the bonding material securing the at least one of the top support and/or the bottom support to the at least one of the plurality of panels;

wherein at least one of the top support and/or the bottom support includes at least two laminate layers to form a support, the first laminate layer comprising fibers oriented at 0 degrees, 90 degrees and +45 degrees and the second laminate layer comprising fibers oriented at 0 degrees, 90 degrees and −45 degrees, wherein the resulting combined laminate layers comprise fibers oriented at 0 degrees, 90 degrees, +45 degrees and −45 degrees.

2. The support beam of claim 1, wherein at least one of the top of the core and/or the bottom of the core is angled from the center portion to at least one of the first side and the second side.

3. The support beam of claim 1, wherein at least one of the top of the core and/or the bottom of the core is angled from the center portion to the first side and to the second side such that the length of the center portion is greater than the length of the first side and greater than the length of the second side.

4. The support beam of claim 1 further comprising bonding material between the panels.

5. The support beam of claim 1 wherein at least one of the first or second outer layer and core form a cavity and wherein the cavity is at least partially filled with bonding material.

6. The support beam of claim 5 wherein at least one of the first or second cavity is generally triangular.

7. The support beam of claim 1 wherein the length of the cavity is at least approximately seven times the thickness of the outer layer.

8. The support beam of claim 1 wherein at least one of the top support or the bottom support extends horizontally beyond the plurality of panels.

9. The support beam of claim 8, wherein the bonding material extends between a major surface of the first side of the first of the plurality of panels to the major surface of the at least one of the top support and/or the bottom support, and the bonding material extends between a major surface of the second side of the last of the plurality of panels to the major surface of the at least one of the top support and/or the bottom support.

10. The support beam of claim 9 wherein at least one of the bonding material joining the major surface of the first side of the first of the plurality of panels to the major surface of the at least one of the top support and/or the bottom support, and/or the bonding material joining the major surface of the second side of the last of the plurality of panels to the major surface of the at least one of the top support and/or the bottom support forms a round corner.

11. The support beam of claim 10 wherein the round corner has a radius that is at least about 7 times the thickness of the outer layer.

12. The support beam of claim 1 wherein at least one of the first or second outer layer and at least one of the top support and/or the bottom support are formed from the same materials.

13. The support beam of claim 1 wherein at least one of the top support or the bottom support is about 3 to 10 times as thick as at least on of the first or second outer layer.

14. A method for forming a support beam from a plurality of panels comprising:

arranging a plurality of panels side by side, each panel having a top, a bottom, a first side and a second side, wherein the second side of a first panel is adjacent to the first side of a second panel;

joining the plurality of panels with bonding material at each of the first side and second side of the plurality of panels, except for the first side of the first of the plurality of panels and the second side of the last of the plurality of panels;

placing a top support adjacent to the top of the panels;

applying bonding material to a major surface of the first side of the first of the plurality of panels and to a major surface of the top support to join the major surface of the first side of the first of the plurality of panels to the major surface of the top support;

applying bonding material to a major surface of the second side of the last of the plurality of panels and to the major surface of the top support to join the major surface of the second side of the last of the plurality of panels to the major surface of the top support;

placing a bottom support adjacent to the bottom of the panels;

applying bonding material to the major surface of the first side of the first of the plurality of panels and to a major surface of the bottom support to join the major surface of the first side of the first of the plurality of panels to the major surface of the bottom support; and applying bonding material to the major surface of the second side of the last of the plurality of panels and to the major surface of the bottom support to join the major surface of the second side of the last of the plurality of panels to the major surface of the bottom support;

wherein at least one of the major surface of the top support and/or the major surface of the bottom support are formed by joining at least two laminate layers to form a support, the first laminate layer comprising fibers orientated at 0 degrees, 90 degrees and +45 degrees and the second laminate layer comprising fibers oriented at 0 degrees, 90 degrees and −45 degrees, wherein the resulting combined laminate layers comprise fibers oriented at 0 degrees, 90 degrees, +45 degrees and −45 degrees.

15. The method of claim 14 wherein applying bonding material to a major surface of the first side of the first of the plurality of panels to the at least one of the major surface of the top support and/or the major surface of the bottom support comprises forming the bonding material to a round corner.

16. The method of claim 14 wherein each of the plurality of panels comprises:

a core having a center portion, a top, a bottom, a first side and a second side, wherein at least one of the top of the core or the bottom of the core is angled from the center portion to at least one of the first side and the second side such that the length of the center portion is greater than the length of at least one of the first side or the second side; and an outer layer in contact with the one of the first side or the second side having a length less than the length of the center portion of the core, the outer layer being positioned to extend beyond the length of the side with which the outer layer is in contact and terminate in substantially the same horizontal plane as the end of the center portion of the core such that the outer layer and core form a cavity; and wherein the method further comprises at least substantially filling the cavity in each of the plurality of panels prior to joining the top support and the plurality of panels.

17. The method of claim 16 further comprising for each of the plurality of panels removing a portion of the core near the outer layer to form the cavity.

18. The method of claim 14, wherein at least one of the step of applying bonding material to the major surface of the first side of the first of the plurality of panels and to a major surface of the bottom support and/or the step of applying bonding material to the major surface of the second side of the last of the plurality of panels and to the major surface of the bottom support comprises forming a round corner of bonding material between the bottom support and the major surface.

19. A method for forming a support beam from a plurality of panels comprising:

arranging a plurality of panels side by side, each panel having a top, a bottom, a first side and a second side, wherein the second side of a first panel is adjacent to the first side of a second panel;

joining the plurality of panels with bonding material at each of the first side and second side of the plurality of panels, except for the first side of the first of the plurality of panels and the second side of the last of the plurality of panels;

joining at least two laminate layers to form a support, the first laminate layer comprising fibers orientated at 0 degrees, 90 degrees and +45 degrees and the second laminate layer comprising fibers oriented at 0 degrees, 90 degrees and −45 degrees, wherein the resulting combined laminate layers comprise fibers oriented at 0 degrees, 90 degrees, +45 degrees and −45 degrees;

applying bonding material to a major surface of the first side of the first of the plurality of panels and to a major surface of the support to join the major surface of the first side of the first of the plurality of panels to the major surface of the support; and applying bonding material to a major surface of the second side of the last of the plurality of panels and to the major surface of the support to join the major surface of the second side of the last of the plurality of panels to the major surface of the support.

* * * * *